US008898920B2

(12) United States Patent
Ward et al.

(10) Patent No.: US 8,898,920 B2
(45) Date of Patent: Dec. 2, 2014

(54) LINEN FOLDING TEMPLATE

(71) Applicants: Roy K. Ward, Fishers, IN (US); Phillip H. Cripe, Carmel, IN (US); Michael D. Beck, Indianapolis, IN (US)

(72) Inventors: Roy K. Ward, Fishers, IN (US); Phillip H. Cripe, Carmel, IN (US); Michael D. Beck, Indianapolis, IN (US)

(73) Assignee: Innovation Efficiens, LLC, Fishers, IN (US)

( * ) Notice: Subject to any disclaimer, the term of this patent is extended or adjusted under 35 U.S.C. 154(b) by 280 days.

(21) Appl. No.: 13/678,531

(22) Filed: Nov. 15, 2012

(65) Prior Publication Data

US 2013/0118021 A1 May 16, 2013

Related U.S. Application Data

(60) Provisional application No. 61/560,613, filed on Nov. 16, 2011.

(51) Int. Cl.

| | |
|---|---|
| ***D06F 89/00*** | (2006.01) |
| ***A47G 9/02*** | (2006.01) |
| ***B65H 45/04*** | (2006.01) |

(52) U.S. Cl.

CPC ..... *B65H 45/04* (2013.01); *B65H 2701/174* (2013.01)

USPC ..... 33/566; 33/562

(58) Field of Classification Search

CPC ..... D06F 89/00; D06F 89/005; A47G 9/02; A47G 9/0238; A47G 9/0246; B65B 63/04; B65H 45/04

USPC ..... 33/562, 563, 566; 223/33, 34, 37, 38; 493/405, 408, 451

See application file for complete search history.

(56) References Cited

U.S. PATENT DOCUMENTS

| | | | | |
|---|---|---|---|---|
| 702,085 | A | 6/1902 | Barnes | |
| 4,421,500 | A | 12/1983 | Smith | |
| 5,154,329 | A | 10/1992 | Dorfmueller | |
| 5,417,641 | A | 5/1995 | Warren | |
| 5,624,366 | A | 4/1997 | Beeri | |
| 6,094,759 | A * | 8/2000 | Thompson | 5/420 |
| 6,269,987 | B1 | 8/2001 | LaPace et al. | |
| 6,360,927 | B1 * | 3/2002 | Barker | 223/37 |
| 6,685,065 | B1 | 2/2004 | Ebling et al. | |
| 6,695,758 | B2 | 2/2004 | Dostie | |
| 6,804,939 | B2 | 10/2004 | Sanborn et al. | |
| 6,814,269 | B1 | 11/2004 | Fernandez et al. | |
| 7,992,712 | B2 * | 8/2011 | Rosland | 206/449 |

(Continued)

FOREIGN PATENT DOCUMENTS

| | | | | |
|---|---|---|---|---|
| DE | 4311583 | A1 * | 10/1994 | D06F 89/00 |
| JP | 08033800 | A * | 2/1996 | D06F 89/00 |

*Primary Examiner* — R. A. Smith

(57) ABSTRACT

A folding template for a fitted sheet includes an elongated panel having a length slightly greater than the neutral width of an elastic end of the fitted sheet, and a width that is less than one-third the length of the fitted sheet. The panel is divided into four segments separated by a hinge configured so that the panel can be folded laterally inward with the fitted sheet engaged around the panel. In a method for folding a fitted sheet, the folding template is engaged in one elastic end of the sheet, spanning the width of the sheet. The template is repeatedly flipped over width-wise along the fitted sheet while maintaining the length of the template intact. Once the template reaches the opposite end of the sheet, the panel is folded inward on itself to a reduced configuration including the fitted sheet.

13 Claims, 3 Drawing Sheets

(56) References Cited

U.S. PATENT DOCUMENTS 8,714,418 B2 * 5/2014 Kumar et al. ..... 223/37
2008/0264983 A1 10/2008 Kastan
2010/0011503 A1 * 1/2010 Hipp ..... 5/496
2010/0162581 A1 7/2010 Ward

* cited by examiner

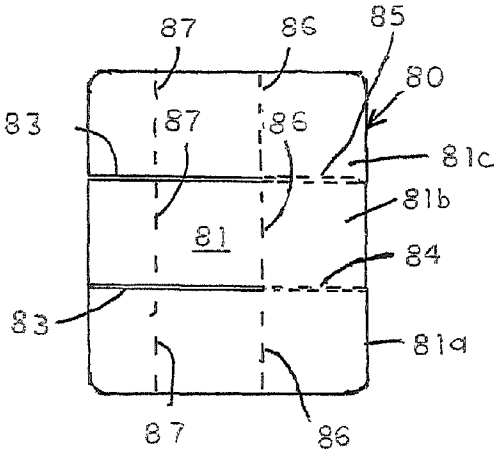
FIG. 12
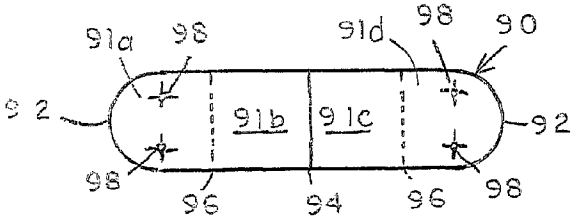
FIG. 13
FIG. 10
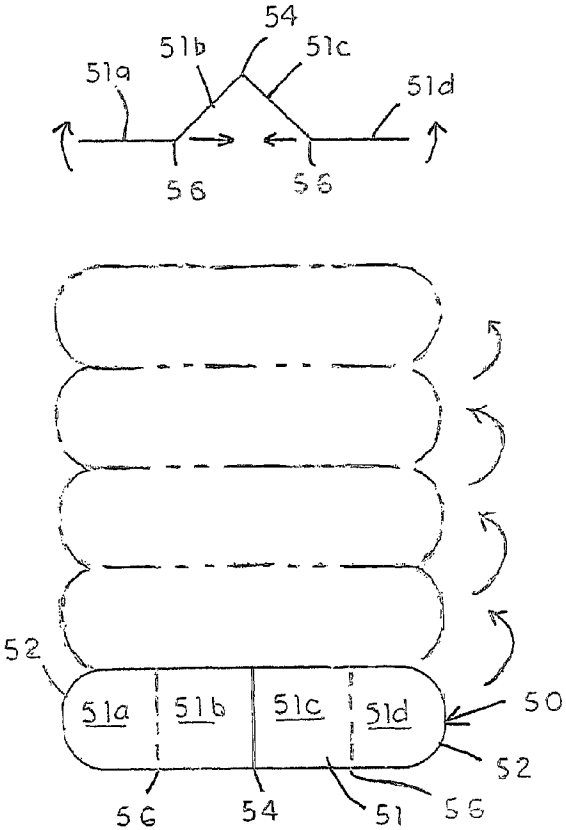
FIG. 9

LINEN FOLDING TEMPLATE

PRIORITY CLAIM

This application claims priority to provisional application No. 61/560,613, filed on Nov. 16, 2011, the entire disclosure of which is incorporated herein by reference.

BACKGROUND

The fitted sheet is the most problematic of the household linens. While it is sometimes difficult to put a fitted sheet on a mattress, it is always difficult to fold the fitted sheet for storage. Only the most accomplished domestic technician is able to fold a fitted sheet into a neat and compact rectangle. This difficulty is accentuated the larger the fitted sheet. Folding a standard king size sheet is cumbersome but even the average person can produce a reasonably uniform folded rectangle or square. But folding a king size fitted sheet is a recipe for frustration and resignation. Most people settle for a somewhat wadded trapezoid that can be stuffed into the linen closet underneath a neatly folded standard sheet.

Various videos are available on the Internet that demonstrate proper techniques for producing a tightly and neatly folded fitted sheet of any size. However, these techniques are, frankly, outside the skill level and dexterity of the average person. Moreover, each of these video-demonstrated techniques require a greater degree of fastidiousness than most people are willing to commit just to fold a bed sheet.

Nevertheless, most people would prefer to have fitted sheets that are folded as neatly as the standard sheets. A properly folded sheet is more compact and easier to store with other linens. As a practical matter, a well-folded sheet avoids wrinkles, particularly where the sheet is made of a material that is easily wrinkled, such as cotton. Moreover, there is a certain aesthetic appeal or satisfaction to a neatly folded sheet.

In spite of all these benefits, most people continue to struggle with the unwieldy fitted sheet. Thus, there is a need for a device that can make folding a fitted sheet achievable by even the least adept among us.

SUMMARY

The answer to the dilemma of folding a fitted sheet is met by a folding template. In one embodiment, the template is a generally rigid but foldable panel that is configured to match the unfolded size and shape of the fitted sheet. The template is provided with pre-determined fold lines that automatically direct a person to make three folds that reduce any size fitted sheet into a tight and neatly folded rectangle. The template panel is thin enough so that it does not add significantly to the thickness of the folded sheet. The panel is formed of a material that does not buckle against the pressure of the elastic bands in the fitted sheet.

In another embodiment, the template is an elongated panel sized to span the width of the open fitted sheet but having a width that is significantly less than the length of the fitted sheet. In one specific embodiment the length is about ⅕ the length of the sheet. The panel includes a center fold line and two lateral fold lines, with the fold lines forming generally equal-length segments. In use, the panel is lodged within one end of the fitted sheet. The panel is then flipped over multiple times until the entire length of the sheet is wrapped around the folding template. The last end of the sheet may be wrapped around the entire panel and sheet arrangement. The template is folded along the center fold line and then the side segments of the panel are folded along the lateral fold lines toward the center fold line to form a compact folded fitted sheet. The result is a tightly folded fitted sheet that occupies as little as about 1/20 the original open area of the sheet. The folding template further provides some stiffness to the folded arrangement so the folded sheet can be stacked neatly within the linen closet. The folded sheet and template can even be stored vertically on a shelf to save space. A caddy may be provided to hold multiple folded sheets.

In another feature, the folding template may be provided with sheet retention features that positively hold or grip a portion of the sheet. In one embodiment, the retention feature is a star-like cut-out formed in the end-most panels of the template into which the sheet is pushed. The star-like cut-out bends to receive the sheet and close around the sheet to hold it in place.

In a further feature, the folding template incorporates a fabric freshener composition. In one embodiment, the panels of the template are treated with the freshener composition. In another embodiment the composition is contained in freshener sheets that are retained on the folding template.

DESCRIPTION OF THE FIGURES

FIG. 9 is a plan view of a folding template according to a further embodiment.

FIG. 10 is a side view of the folding template of FIG. 9 shown with the template panel partially folded.

FIG. 12 is a plan view of a folding template according to still another embodiment.

FIG. 13 is a plan view of a folding template incorporating a sheet retention feature.

DESCRIPTION OF THE PREFERRED EMBODIMENTS

Figure 1:
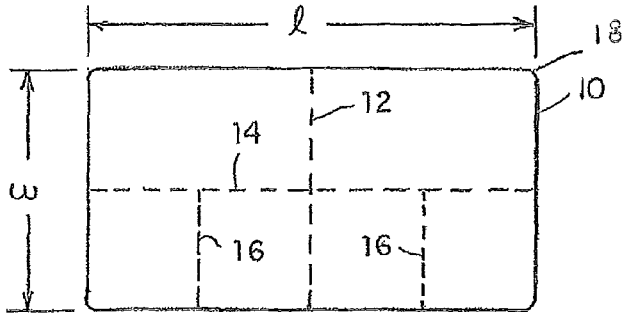
FIG. 1 is a top plan view of a folding template for linens according to one embodiment of the invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
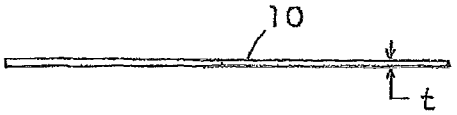
FIG. 2 is a side view of the folding template shown in FIG. 1.

In one embodiment, a fitted sheet folding template includes a generally flat panel 10, as shown in FIGS. 1-2. The panel has a length l and width w that are generally equal to the dimensions of the fitted sheet when it is installed on a mattress. Due to the elastic bands in the fitted sheet, these dimensions of the panel 10 will be greater than the overall dimensions of the fitted sheet in its neutral state—i.e., when the elastic ends of the sheet have not been stretched.

As shown in the plan view of FIG. 1, the panel 10 includes an arrangement of fold lines 12, 14 and 16. These fold lines are defined in the panel to permit repeated folding or pivoting about the fold line. Thus, the fold lines may be formed by a line of reduced thickness, by a line of reduced stiffness or by a mechanical hinge element. In one exemplary embodiment, the panel 10 has a thickness t (FIG. 2) while each fold line 12, 14 and 16 can have a thickness of about ½ t. Thus, the fold lines may be formed as a "living hinge". This approach is particularly well-suited for a panel 10 formed of a polymeric or plastic material, such as polypropylene that can withstand multiple bends about the living hinge without failure or tearing.

Alternatively, the fold lines may be defined by lines of reduced stiffness relative to the remainder of the panel 10. In one exemplary embodiment, this approach may be achieved by a row of score lines or perforations. This line of reduced stiffness is suited for a polymeric or plastic material as well as for a cellulosic material.

The third approach of providing a mechanical hinge element may be implemented in panels formed of a wide range of materials. Each fold line may be provided with a plurality of hinge elements distributed along the length of the fold line, or by a hinge element spanning the length of the particular fold line. However, it is appreciated that a hinge element spanning an entire fold line can only be accomplished for the fold lines 16. Hinge elements for fold line 14 must be discontinued at the location of the other fold lines 12 and 16. Likewise, hinge elements for the fold line 12 must be discontinued at the fold line 14 to permit folding at that line. In a specific embodiment, the hinge elements may be thin plastic pintle-type hinges or may be "living hinge" strips that are affixed to the panel. With this approach the panel 10 itself is provided in segments corresponding to areas bounded by each of the fold lines 12, 14 and 16. Thus, as shown in FIG. 1, the three fold lines produce six panel segments that are connected by corresponding hinge elements.

The hinge lines 12, 14 and 16 are arranged so that the panel 10 may be first folded over onto itself at the first hinge line 12. The resulting folded panel is then again folded over onto itself along the second hinge line 14. Finally, the resulting folded panel is folded over along the third hinge line 16. More particularly, the fold lines are preferably defined parallel to a width or length dimension of the panel. Moreover, successive fold lines are defined orthogonal to each other. In other words, a successive fold is made at a perpendicular angle relative to the prior fold.

It can be appreciated that after each fold, the next fold line must be capable of making the fold over an increased thickness. For instance, after the first fold is made along fold line 12, the next fold along line 14 must be made with one half of the panel 10 overlapping the other half. Similarly, when the last fold is made along fold line 16, four layers of panel 10 must be folded. Thus, it is contemplated that the fold line 14 be configured to permit folding of a thicker folded panel, and that the fold line 16 is configured for an even thicker folded panel. For example, in the configuration in which each fold line is defined by a "living hinge", the line of reduced thickness may have a width of about 0.05 inches. For a panel 10 having a thickness t of 0.06 inches, the resulting folded panel will have a thickness of at least twice the panel thickness, or about 0.12 inches. The "living hinge" for the second fold line 14 must be sized to accept a fold in a 0.12 inch thick stack so that the "living hinge" may have a width of about 0.15 inches. Similarly, the living hinge for the last fold line 16 may have a width of about 0.30 inches to achieve the final fold.

The folding template of the present invention provides a simple and virtually fail-safe method for neatly and compactly folding a fitted sheet. As shown in the sequence of FIGS. 3-7, the panel 10 is fully opened and laid into the fitted sheet 20. In particular, the fitted sheet is stretched slightly to fit around the perimeter of the panel 10, with the ends 21, 22 and sides 23, 24 snugly engaged around the panel. The corners 18 of the panel 10 may be rounded to correspond to the rounded corners 26 of the fitted sheet created by the elastic bands within the sheet.

Figure 4:
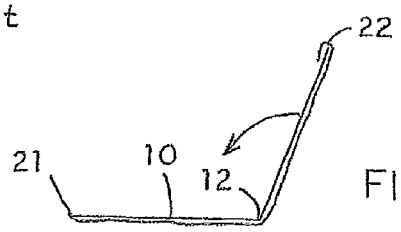
FIG. 4 is a side view of a first fold accomplished with the folding template shown in FIG. 3.
Figure 3:
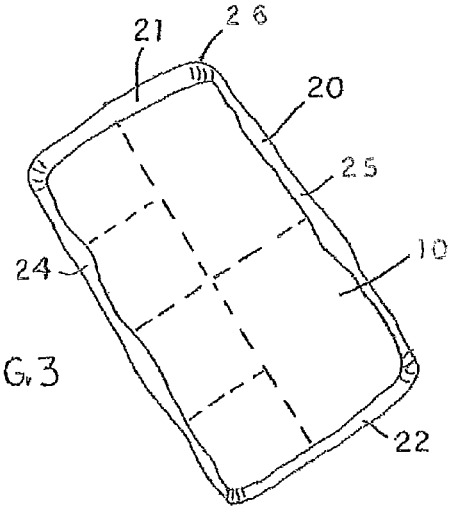
FIG. 3 is a top view of a folding template according to the present invention disposed within a fitted sheet.
Figure 5:
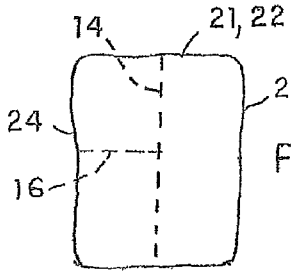
FIG. 5 is a top view of the result following the first fold.
Figure 6:
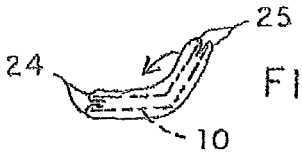
FIG. 6 is an end view of a second fold accomplished with the folding template.
Figure 7:
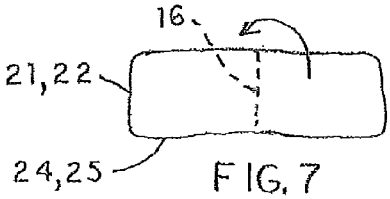
FIG. 7 is a top view of the result following the second fold.

With the fitted sheet wrapped around the panel 10, the first fold along fold line 12 is made by bringing end 22 in overlapping arrangement with end 21, as shown in FIG. 4. The resulting folded panel and sheet is shown in FIG. 5. It can be appreciated that the fold line 14 extends along the two overlapping portions of the panel 10, so that the fold line 14 in each portion also overlap. The second fold is then made along fold line 14, as shown in FIG. 6, resulting in a folded panel and sheet as depicted in FIG. 7. The final fold is made along fold line 16 so that the result is a fitted sheet folded into a generally rectangular shape.

The panel 10 has a thickness t that is sufficient for the overall panel 10 to resist bending or buckling when the fitted sheet 20 is wrapped around the panel. On the other hand, this thickness t is sufficiently thin to accommodate three folds without adding significant thickness to the folded fitted sheet. In a preferred embodiment, the panel 10 is a polypropylene sheet having a thickness of about 0.06 or 1/16 inches. After three folds, the overall thickness of the folded panel is only about 0.24 or ¼ inches. A fitted sheet may have a thickness of half the folding template panel 10 and an overall folded thickness when pressed flat of less than about ⅛ inch. While the ¼ inches of the folded panel is twice the thickness of the folded sheet, even this increased thickness is significantly less than the overall thickness of a badly folded fitted sheet. The folding template of the present invention ensures a repeatable folding process resulting in a tightly folded fitted sheet having a total thickness of less than ½ inch.

The folding template of the present invention can be sized for any size fitted sheet from king to single. The arrangement of fold lines 12, 14 and 16 is unchanged regardless of the size of the fitted sheet. The folding process is also unchanged, although it is certainly less cumbersome for a single size fitted sheet than for a king size sheet.

Figure 8:
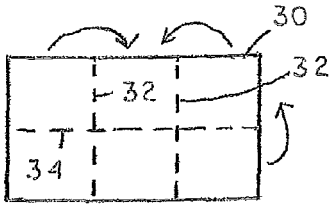
FIG. 8 is a plan view of a folding template according to a further embodiment.

In the illustrated embodiment, the fold lines are arranged so that the panel, and therefore the fitted sheet, is essentially folded in half with each fold. Alternatively, the fold lines may be modified to achieve other folding patterns. For instance, the first fold line 12 may include two fold lines so that the panel is folded in thirds. Thus, as illustrated in FIG. 8, the modified folding template panel 30 may include two fold lines 32 and a single second fold line 34. With this embodiment, the two sides of the panel 30, and consequently the fitted sheet, are folded inward along fold lines 32 overlapping each other and the center third of the panel. The resulting folded panel is then fold over onto itself along fold line 34 so that the resulting folded fitted sheet is one-sixth its original size. This folding pattern may be preferable for smaller fitted sheets, such as single or double sized sheets.

For any fold pattern, the folding template includes at fold lines to accomplish at least two orthogonal folds—i.e., successive folds that are at right angles to each other. Thus, in the embodiment of FIG. 1, the panel 10 the first fold is along fold line 12, while the second fold is perpendicular along fold line 14. The final fold is perpendicular to the second fold along fold line 16. Likewise, with the embodiment of FIG. 8, the initial folds along fold line 32 are perpendicular to the second fold along fold line 34. This approach ensures a compact and uniform folded sheet, while also maintaining the fitted sheet tight across the folded panel portions.

In another embodiment, a folding template 50 shown in FIG. 9 includes an elongated panel 51. The panel has a length that is equal to, or slightly greater than, the width of a fitted sheet in its neutral configuration when the elastic ends are not stretched. Thus, the length of the panel may be different for different sizes of sheets, namely single, double, queen, king, etc. The panel 51 includes rounded lateral edges 52 that are configured to fit within the bunched or rounded corners 61 (see FIG. 11*a*) of the standard fitted sheet. The panel may be sized to hold on end of the fitted sheet is slight tension. The panel 51 has a width that is significantly less than the length of the fitted sheet. The width of the panel 51 is preferably less than ⅓ the length of the fitted sheet. In one preferred embodiment the panel has a width that is about ⅕ the length of the sheet.

The panel 51 is provided with three hinges or fold lines, namely a center fold line 54 and two lateral fold lines 56 flanking the center fold line. The hinges or fold lines are configured so that the closing direction of the hinges alternate between segments. The fold lines are preferably equidistant to divide the panel into four generally equal length segments 51*a*, 51*b*, 51*c* and 51*d*. The fold lines may incorporate a variety of hinge or folding components. For instance, the fold lines may be formed by score lines in the panel 51, may incorporate a living hinge, or may utilize a mechanical hinge element, such as a piano-type hinge. However, it is preferred that the hinges 54, 56 be formed in the material itself to simplify construction and maintain a thin profile for the folding template 50. Moreover, the fold lines must be sufficiently wide to accommodate the sheet material when the template is in its fully folded configuration. Thus, in the instance of a living or integral hinge, the fold lines may be a flattened portion of the panel material having a much-reduced rigidity relative to the remainder of the panel. In one embodiment, the flattened portion can have a width of about ⅛-¼ in.

As shown in FIG. 10, the center fold line 54 is configured so that the two center-most segments 51*b*, 51*c* pivot upward when folded toward each other. The lateral fold lines 56 are configured to permit the center-most segments to fold upward and also so that the outboard segments 51*a*, 51*d* can be folded upward toward the center fold line 54, as represented by the arcuate arrows at the sides of the panel 51.

Figure 11B:
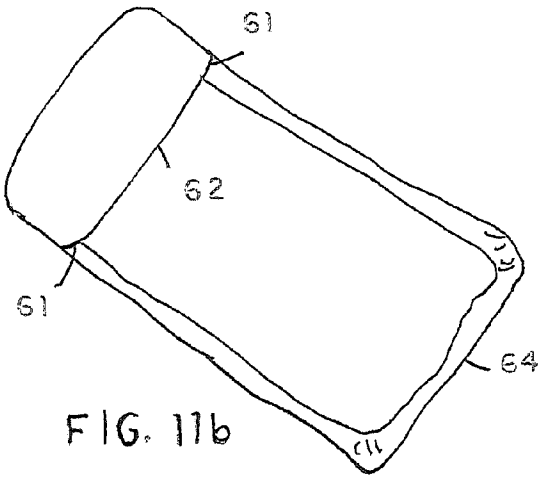
FIGS. 11*a-e* are a series of figures showing the sequence of using the folding template of FIGS. 9-10 with a fitted sheet.
Figure 11A:
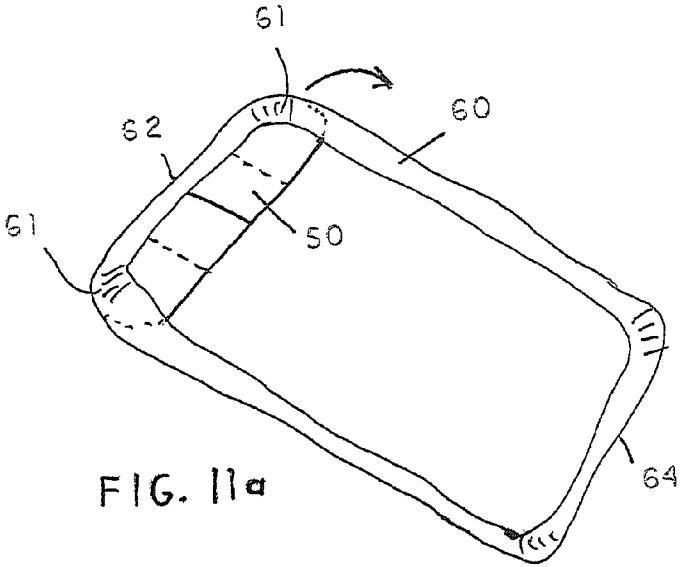
Figure 11E:
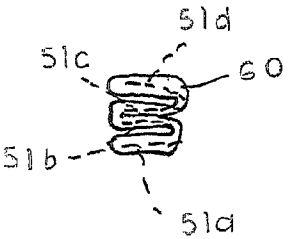

The hinges or fold lines 54, 56 are further configured so that the segments 51*a*-51*d* lie substantially parallel to each other when the template and fitted sheet are fully folded (as shown in FIG. 11*e*). In other words, when the template is folded, portions of the fitted sheet will be disposed within each hinge or fold line. The hinges are thus configured so that the sheet material does not prevent the hinge or fold line from fully closing. Thus, in one specific embodiment, the fold line has a narrow width that is sufficient to receive the sheet material without compromising the hinge function. This "widened" hinge construction is particularly suited to a template 50 formed of a cellulosic material, such as a multi-ply or corrugated cardboard.

In one specific embodiment, the folding template is sized for a king-size fitted sheet, so that the template has an overall length of 80 inches. The segments 51*a*-*d* have a length of 19.5 inches, with the difference between the combined length of the segments (4×19.5=78 inches) due to the width of the hinges or fold lines 54, 56. In this specific embodiment the panel 51 has a width of 12 inches so that the template can be easily manipulated by the user, although a greater width of 20 inches is also acceptable. It can be appreciated that a folding template having an overall length of 80 inches can be "one size fits all", meaning that the same folding template can be used for several fitted sheet sizes. For king and queen size sheets the template is sized to fit width-wise across the sheet. However, for the smaller double and twin size sheets, the same template can be oriented lengthwise and used in the same way to reduce the fitted sheet to a much smaller, tightly folded package.

The manner of using the folding template 50 is illustrated in the sequence shown in FIGS. 11*a*-11*e*. In the first step the template is positioned within one end 62 of a fitted sheet 60. The curved ends 52 of the panel are lodged within the bunched corners 61 of the sheet. The panel is sized to maintain slight tension in the fitted sheet around the panel so that the body of the sheet may be taut across the panel. The panel 51 may be provided with a feature to help hold the sheet on the panel. For instance, the ends 52 of the panel may be provided with a hook-and-loop type layer or soft adhesive layer that lightly grabs the sheet without adhering. Alternatively, a clip may be provided to slip onto the sheet.

In the next step shown in FIG. 11*b*, the folding template is flipped over onto the remainder of the open sheet with the end 62 tight against the template. The step of flipping the template is repeated three more times (in the illustrated embodiment) until the template and fitted sheet appear as in FIG. 11*c*. In this configuration, the opposite end 64 of the fitted sheet may be wrapped around the template.

Figure 11D:
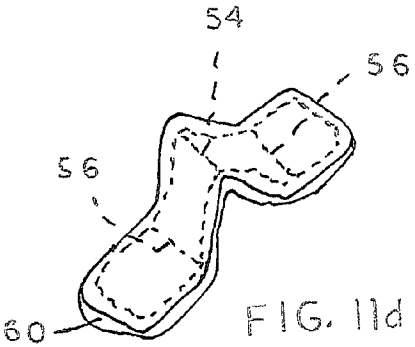
Figure 11C:
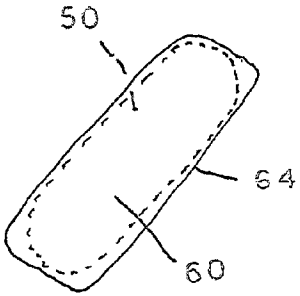

Next, the template is at least partially folded at the center fold line 54, as illustrated in FIG. 11*d*. The template is then folded about the lateral fold lines 56 toward the center fold line so that all of the panel segments 51*a*-51*d* converge. The result is a tightly packed folded fitted sheet, as shown in FIG. 11*e*.

The panel 51 may be formed of a thin high strength plastic material, cellulosic material that may be flat, corrugated or honeycomb, with a thickness of about 0.125 in, although other suitable materials and thickness may be used. When the folding template is folded with the fitted sheet the resulting folded sheet package is less than about 3 in. thick, depending upon the thickness of the fitted sheet itself. A band may be provided to wrap around the folded sheet to hold it in its folded configuration. The folding template 50 is sufficiently rigid when folded to maintain the sheet in its folded configuration even when standing vertically. The folding template 50 thus not only greatly simplifies folding a troublesome fitted sheet, it also facilitates storage of the fitted sheets. It is envisioned that multiple fitted sheets may be folded compactly with the present folding template 50 and then stored within a linen closet in a horizontal stack or a vertically aligned row.

In another embodiment, a folding template 80, shown in FIG. 12, includes a flat panel 81 that is sized to fit within the entire fitted sheet, like the panel 10. The panel 81 is separated into three long segments 81*a*-81*c* separated by lengthwise cut lines 83 that extend along ⅔ the length of the panel. The remaining ⅓ of the panel length includes fold line 84, 85. Each panel segment 81*a*-81*c* further includes horizontal fold lines 86 and 87 that separate each segment into three subsegments.

In use, the panel 81 is positioned within the fitted sheet with the rounded corners of the panel within the bunched corners of the sheet. The panel with the sheet around it is folded one direction along the fold lines 86 and in the opposite direction along the fold lines 87. The panel is then folded in one direction along fold line 84 and in the opposite direction along fold line 85 to complete the folding of the fitted sheet.

In a further embodiment, a folding template 90 shown in shown in FIG. 13 incorporates sheet retention features incorporates sheet retention features 98. The retention features are at least in the outermost segments 91*a*, 91*d* of the template adjacent the lateral edges 92. In addition, two such features 98 may be incorporated into the segments 91*a*, 91*d*. Retention features may also be incorporated into the interior segments 91*b*, 91*c*, preferably evenly spaced between the fold lines 94, 96.

The retention features 98 are configured to grasp and hold the sheet on the corresponding panel. In one embodiment, the retention features are in the form of star-like cut-outs formed in the segments. The panel material at the star-like cut-out bends to receive the sheet and then closes around the sheet to hold it in place. The folding template 90 is used in the manner described above with respect to FIGS. 9-11, except that in the initial step after the template is placed within one end of the fitted sheet portions of the sheet are pushed into the star-like cut-outs of the retention features 98. In the illustrated embodiment including two retention features on each segment allows the user to engage the sheet to the template regardless of how the template is initially oriented within the sheet.

In a further feature, the folding template may incorporate a fabric freshener composition. In one embodiment, the segments of the template are treated or impregnated with the freshener composition. One such composition is the FEBREZE® fabric refresher that can be sprayed onto the folding template. In another embodiment the composition is contained in freshener sheets that are retained on the folding template, such as by one of the sheet retention features 98. An exemplary freshener sheet is the BOUNCE® dryer sheet product. Alternatively, one or more of the segments may be provided with a slot or pouch sized to receive a freshener sheet.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For instance, in the illustrated embodiment of FIG. 13 the sheet retention feature is not limited to the described star-like cut-out. Other features may be utilized that are capable of at least temporarily gripping or engaging the sheet as it is folded using the template. For instance, a hook-and-loop type fastener element or a low-adherent pad may be used for the retention features 98.

What is claimed is:

1. A folding template for a fitted sheet with elastic ends having a length and a neutral width when the elastic ends are not stretched, the template comprising:

an elongated panel having a length at least equal to the neutral width of the fitted sheet and a width that is less than ⅓ the length of the fitted sheet;

said panel divided into at least four segments separated by hinges extending perpendicular to said length, wherein the closing direction of the hinges alternates between segments, and further wherein said hinges are configured so that said segments fold substantially flat when a sheet is positioned within the hinge.

2. The folding template of claim 1, wherein said panel is formed of a cellulosic material.

3. The folding template of claim 1, wherein said panel has a thickness of about 1/16-⅛ inch.

4. The folding template of claim 1, wherein the width of said panel is 12-20 inches.

5. The folding template of claim 1, wherein at least said outermost segments of said panel include a sheet retention feature configured for retaining a portion of the sheet in contact with the panel.

6. The folding template of claim 5, wherein said sheet retention feature includes a star-like cut-out defined in said panel and configured to receive the portion of the sheet pushed therethrough.

7. The folding template of claim 1, wherein the outermost segments include rounded lateral edges.

8. The folding template of claim 1, wherein said length is greater than the neutral width of the fitted sheet.

9. The folding template of claim 1, wherein said segments of said panel are of substantially equal length.

10. The folding template of claim 1, further comprising a fabric freshener composition associated with said panel.

11. The folding template of claim 10, wherein at least one of said segments of said panel is treated or impregnated with said freshener composition.

12. A method for folding a fitted sheet with elastic ends having a length and a neutral width when the elastic ends are not stretched, comprising:

a) providing a folding template including an elongated panel having a length at least equal to a neutral unstretched dimension of the fitted sheet and a width that is less than ⅓ the length of the fitted sheet, the panel divided into segments separated by hinges in which the closing direction of the hinges alternates between segments;

b) inserting the elongated panel across the neutral dimension at one of the elastic ends of the fitted sheet;

c) flipping the panel across its width while keeping the length of the panel intact so that the panel with the elastic end of the fitted sheet engaged on the panel overlaps an adjacent portion of the fitted sheet;

d) repeating the flipping step until the panel is at the opposite elastic end of the fitted sheet;

e) folding the outermost segments of the panel inward against the innermost segments and folding the innermost segments of the panel together until the folding template is substantially flat with the fitted sheet engaged thereon.

13. The method of claim 12, further comprising engaging the opposite elastic end around the panel of the folding template at the end of the repeated flipping steps.

* * * * *